US007614403B2

(12) United States Patent
Nomura

(10) Patent No.: US 7,614,403 B2
(45) Date of Patent: Nov. 10, 2009

(54) DEVICES AND METHODS FOR APPLYING HAIR EXTENSIONS

(75) Inventor: Tomoyasu Nomura, Nagoya (JP)

(73) Assignee: REJOUIR, Ltd., Atsuta (JP)

( * ) Notice: Subject to any disclaimer, the term of this patent is extended or adjusted under 35 U.S.C. 154(b) by 0 days.

(21) Appl. No.: 11/198,654

(22) Filed: Aug. 5, 2005

(65) Prior Publication Data

US 2006/0027244 A1 Feb. 9, 2006

(30) Foreign Application Priority Data

Aug. 6, 2004 (JP) ..... 2004-230826

(51) Int. Cl.
*A41G 3/00* (2006.01)
*A41G 5/00* (2006.01)

(52) U.S. Cl. ..... 132/201; 132/53

(58) Field of Classification Search ..... 132/201, 132/53, 54, 55, 56

See application file for complete search history.

(56) References Cited

U.S. PATENT DOCUMENTS

| | | | | |
|---|---|---|---|---|
| 5,107,867 | A * | 4/1992 | Barrington | 132/201 |
| 5,894,846 | A * | 4/1999 | Gang | 132/201 |
| 6,938,624 | B2 * | 9/2005 | Arroyo et al. | 132/201 |
| 2004/0149302 | A1 * | 8/2004 | Toda | 132/201 |
| 2005/0011530 | A1 * | 1/2005 | Chang | 132/53 |
| 2005/0268932 | A1 * | 12/2005 | Gold | 132/201 |

* cited by examiner

*Primary Examiner*—Robyn Doan
(74) *Attorney, Agent, or Firm*—Lahive & Cockfield, LLP; Anthony A. Laurentano

(57) ABSTRACT

A device (10) for applying a bunch of synthetic hair comprises a cylindrical body made of an elastic material having a synthetic hair retaining hole (12) formed therethrough along a center axis of the cylindrical body. Further, the retaining hole has an opening at either end of the cylindrical body and is adapted to hold a person's hair (26) and hair extensions (28) in the hole. In addition, a pair of tapered surfaces is provided on an outer surface of the cylindrical body, with the tapered surfaces reducing in diameter from a center of the cylindrical body to the respective ends of the cylindrical body.

13 Claims, 3 Drawing Sheets

DEVICES AND METHODS FOR APPLYING HAIR EXTENSIONS

RELATED APPLICATION(S)

This application claims priority on Japanese Patent Application No. 2004-230826 filed on Aug. 6, 2004.

BACKGROUND OF THE INVENTION

1. Field of the Invention

The present invention relates to devices, systems and methods for applying or attaching a bunch of natural and synthetic hair to a person's own hair.

2. Description of the Related Art

Natural human hair or synthetic hair is applied or attached to a person's own hair, known in the art as hair extensions, by using various methods, systems, and devices. As for human hair extensions, the present invention includes application of other persons' hair as well as their own hair. As for non-human and synthetic hair extensions, the present invention includes application of not only synthetic hair but also leather straps, hemp yarn and twine, beads, bird feathers, animal hair, and any other suitable materials that have ornamental or decorative value.

These methods and techniques generally apply or attach human hair or hair application fibers (hair extensions) to the hair growing on a person's head. Specific examples of hair extensions include addition of colorful hair application fibers to highlight or put streaks in the hair as well as a buildup of the hair volume of a person, such as a beauty parlor client, whose hair lacks a volume by applying human hair bunches. Hair extensions appear to be gradually coming into fashion as they offer a wider variety of hair designs.

Conventionally, hair extensions are applied by plaiting the client's own hair and the extensions in three or four strands or by using a metal tube called a tip. To plait the client's hair and the extensions in three strands, for example, an appropriate amount of the client's hair is taken and the middle portion of a matching amount of hair extensions is turned around it. Then, the portion of the extensions from the turns to the top of the extensions, the portion of the extensions from the turns to the bottom of the extensions, and the client's hair are plaited four to six times. Subsequently, the end of the three strand plait is fastened with a rubber thread or any other appropriate means.

To plait the client's hair and the extensions in four strands, for example, the hair dresser (or whoever is applying the extensions) divides an appropriate amount of the client's hair into two bunches, interposes the center of the extension between the client's bunches, and crosses and tightens the two bunches of the client's hair around the extensions. Then, the hair dresser crosses the both ends of the hair extensions so as to place the client's crossed hair between the hair extensions and tighen the extensions around the client's hair. As the next step, the two bunches of client's hair and the extensions, which are tightened at the center, are plaited in four strands, with the end of the four strand plait fastened with a rubber thread or any other appropriate means.

The tip method typically requires a pair of pliers and a dedicated needle as well as the tip, which is a short, crushable metal tube. FIG. 5 shows one example of such needles. As illustrated, this needle (20) includes a wire that is mounted on a handle and bifurcates at an intermediate point to form a sharp loop (22) pointed at its top end. As shown in FIG. 6, the bottom end of one of the looped bifurcations is pivotally attached to the other at the branch point so as to permit the pivotal bifurcation to function as an opener/closer (24). That is, that bifurcation is capable of opening outward to break the loop and closing inward to form the loop. The loop, when formed, has a sharp oval shape and can be flattened, for example, by pressing down the opener/closer to allow its easy passage into a small diameter hole.

To apply hair extensions with a tip, the needle is passed through the tip and the opener/closer is opened to place a bunch of client's hair in the opened loop. Then, the loop is flattened by pressing down the opener/closer and the needle is pulled out through the tip to pass the bunch of hair through the tip from one end (first end) to the other end (second end) of the tip. In the next step, the needle is passed back though the tip from the first end to the second end, where the loop is reopened to place the hair extensions therein. When the loop is closed and the needle pulled out of the tip at the first end, the extensions are also passed through the tip. Subsequently, the tip is appropriately positioned on the hair and the extensions and crushed to hold them together.

Of the aforementioned methods of applying hair extensions, the three strand plaiting method offers the advantage that it can be done by one person. In this method, however, the extensions cannot be secured to the hair as strongly as the four strand plating. Conversely, while the four strand plaiting method can secure the extensions to the person's hair more strongly and create a thicker plait than the three strand plaiting, this method cannot be performed by one person. Although the tip and needle method can be easily performed and allows extensions to be applied close to the scalp, it has the disadvantage that the applied extensions come off relatively easily.

Japanese Patent No. 3,338,433, entitled "Methods for Applying Fibers to Hair", is directed to improved methods for three and four strand plaiting. According to the invention disclosed in this patent, the top portion of a bunch of a person's hair and both ends of a bunch of synthetic hair fibers are plaited in three or four strands. Then, the part of the synthetic bunch previously separated from the main bunch is turned around the plait. Subsequently, the end of the synthetic bunch that is turned around the plait is heat sealed to complete the procedure.

While these methods and devices achieve their intended objective, they are not free from certain problems and inconveniences. For example, applying extensions by these plaiting methods is time-consuming and requires the beauty parlor client or any other person receiving hair extensions to remain seated during the procedure. This in turn makes these procedures costly as well as time-consuming.

On the other hand, the method of applying hair extensions that uses a metal tube or tip provides a procedure that is less time-consuming and easy to perform. However, the resultant attachment is less durable and is effective for relatively a short period of about one week to one month. On the other hand, the three strand plaiting method remains effective for one to one and a half months, with the effective period of the four strand plaiting method ranging from two to three months.

In the tip method, the tip is crushed to secure the hair extensions to the person's own hair, invariably creating sharp metal edges near the scalp. This often causes hair to be caught on the metal during brushing. Moreover, if the person's hair receives impact and a sharp edge of the crushed tip happens to be in the vicinity, this may hurt or injure the scalp or other body parts.

SUMMARY OF THE INVENTION

In view of the above-identified problems, an important object of the present invention is to provide a method of securely and durably applying hair extensions to a person's own hair without damaging the scalp or any other parts of the person's body.

Another object of the present invention is to provide a device for securely and durably applying hair extensions to a person's own hair without damaging the scalp or any other parts of the person's body.

A still other object of the present invention is to provide a device, a system, and a method for applying hair extensions to a person's own hair quickly and durably without damaging the scalp or any other parts of the person's body.

The above objects and other related objects are realized by the invention, which provides a device for applying a bunch of synthetic hair, comprising a cylindrical body made of an elastic material having a synthetic hair retaining hole formed therethrough along a center axis of the cylindrical body. The retaining hole has an opening at either end of the cylindrical body and the hole is adapted to hold a person's hair and hair extensions. The retaining hole extends from a first axial end to a second axial end of the cylindrical body. The retaining hole has a constant diameter. A central portion of the cylindrical body has a cross-sectional thickness that is greater than a cross-sectional thickness of the cylindrical body at the first and second axial ends.

In one embodiment, a pair of tapered surfaces is provided on an outer surface of the cylindrical body, with the tapered surfaces reducing in diameter from a center of the cylindrical body to the respective ends of the cylindrical body.

For example, a dedicated needle, such as the one described above, is used to pass a suitably sized bunch of a person's hair through the hair retaining hole. An appropriate amount of hair extensions is taken to form a thickness that fits in the hair retaining hole. Then, the hair extensions are joined at one end thereof with adhesive to form on that end a fixing end piece having a predetermined length and hardness. When the fixing end piece is inserted into the retaining hole from the second end thereof, the person's hair is secured between the fixing end piece and the retaining hole, also securing the fixing end piece in the retaining hole. The fixing end piece has an outer diameter that is larger than the diameter of the retaining hole. Additionally, the tapered surfaces formed on the cylindrical applying device increase the surface friction resistance to prevent fingers from slipping on the fixing end piece during insertion and removal of the end piece from the retaining hole, thus facilitating the insertion and removal of the fixing end piece.

According to one aspect of the present invention, the hair extensions are selected from the group consisting of a bunch of human hair, a bunch of synthetic hair, and an ornamental object.

According to another aspect of the present invention, the cylindrical body includes on an outer surface thereof a pair of steps, one on either side of the center, that connect the center with the ends of the cylindrical body such that each end of the cylindrical body has a smaller diameter than that at the center of the cylindrical body.

These steps formed on the cylindrical body increase the surface friction resistance with fingers to facilitate the insertion and removal of the fixing end piece. The specific configuration of the tapered surface is not limited to a frustoconical shape or a stepped surface as described above but includes contours of an oval ball or a rugby ball.

According to still another aspect of the present invention, the elastic material comprises a silicon rubber.

The present invention is also directed to a method of applying synthetic hair comprising the steps of:

providing a device for applying a bunch of synthetic hair, the device comprising cylindrical body made of an elastic material having a synthetic hair retaining hole formed therethrough along a center axis of the cylindrical body, the retaining hole including an opening at either axial end of the cylindrical body;

passing a bunch of a person's hair through the hair retaining hole from a first one to a second one of the two ends; and taking an appropriate amount of hair extensions to form a thickness that fits in the hair retaining hole and joining one end of the hair extensions with adhesive to form on that end a fixing end piece having a predetermined length and hardness. This allows easy insertion of the hair extensions into the retaining hole and removal of the extensions therefrom.

The method additionally includes the step of inserting the fixing end piece into the retaining hole from the second end thereof so as to secure the bunch of person's hair to the fixing end piece in the retaining hole. In this way, the person's hair inserted into the retaining hole is secured between the fixing end piece, which is fitted in the retaining hole, and the retaining hole, simultaneously securing the fixing end piece in the retaining hole. This allows easier application and removal of hair extensions than do conventional hair extensions methods. In addition, this method, not requiring direct application of adhesive to the person's hair, metal fastening hardware, or a heating device, such as an iron, provides an easy and safe procedure for applying hair extensions without damaging the hair.

In one embodiment, the cylindrical body includes a pair of tapered surfaces provided on an outer surface thereof, with the tapered surfaces reducing in diameter from a center of the cylindrical body to both ends of the cylindrical body.

In addition, the present invention is directed to a method of applying synthetic hair that comprises the steps of:

providing a device for applying a bunch of synthetic hair, the device comprising cylindrical body made of an elastic material having a synthetic hair retaining hole formed therethrough along a center axis of the cylindrical body, the retaining hole including an opening at either axial end of the cylindrical body;

passing a bunch of a person's hair through the hair retaining hole from a first one to a second one of the two ends; and taking an appropriate amount of hair extensions to form a thickness that fits in the hair retaining hole and joining one end of the hair extensions by placing and heating a heat-shrinkable resin tube around that end to secure the tube therearound and form a fixing end piece having a predetermined length and hardness. This allows easy insertion of the hair extensions into the retaining hole and removal of the extensions therefrom.

The method additionally includes the step of inserting the fixing end piece into the retaining hole from the second end thereof so as to secure the bunch of person's hair to the fixing end piece in the retaining hole. In this way, the person's hair inserted into the retaining hole is secured between the fixing end piece, which is fitted in the retaining hole, and the retaining hole, simultaneously securing the fixing end piece in the retaining hole. This allows easier application and removal of hair extensions than do conventional hair extensions methods. In addition, this method, not requiring direct application of adhesive to the person's hair, metal fastening hardware, or a heating device, such as an iron, provides an easy and safe procedure for applying hair extensions without damaging the hair.

In one embodiment, the cylindrical body includes a pair of tapered surfaces provided on an outer surface thereof, with the tapered surfaces reducing in diameter from a center of the cylindrical body t o both ends of the cylindrical body.

The present invention is additionally directed to a system for attaching a first bunch of fibers to a second bunch of fibers. The system comprises a cylindrical body made of an elastic material having a fiber retaining hole formed therethrough along a center axis of the cylindrical body. The retaining hole has an opening at either end of the cylindrical body and the hole is adapted to hold the first and second bunch of fibers. The system further comprises a fixing end piece provided on an end of the first bunch of fibers. The fixing end piece is fitted into one of the openings of the retaining hole when the second bunch of fibers is placed through the retaining hole such that the fixing end piece secures the first bunch to the second bunch of fibers in the retaining hole.

The foregoing fibers include natural human and non-human hair, synthetic hair, other types of natural animal and plant fibers, synthetic fibers, filaments, threads, year, twine, and any other suitable materials.

In one aspect, the fixing end piece is formed by applying adhesive to the first bunch of fibers.

In another aspect, the fixing end piece includes a heat-shrinkable tube heat-shrunken around the first bunch of fibers.

In one embodiment, the cylindrical body includes a pair of tapered surfaces provided on an outer surface thereof, with the tapered surfaces reducing in diameter from a center of the cylindrical body to both ends of the cylindrical body.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

DETAILED DESCRIPTION OF PREFERRED EMBODIMENTS

Preferred embodiments of the present invention will be described hereinafter with reference to the attached drawings.

Figure 1:
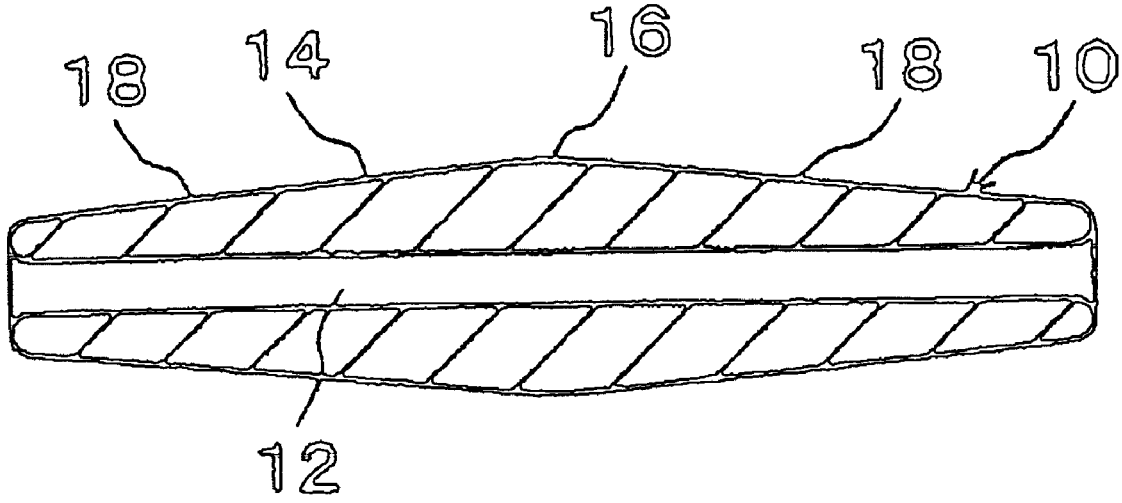
FIG. 1 is a cross section of a synthetic hair application device according to the present invention.

FIG. 1 is a cross-sectional side view of a synthetic hair applying device 10 according to one embodiment of the present invention. The synthetic hair applying device 10 generally has a cylindrical shape with a hair retaining hole 12 formed through the center axis thereof. Provided on the outer surface 14 of the synthetic hair applying device 10 is a pair of tapered surfaces 14 gradually reducing in diameter from the center 16 to both ends of the applying device 10. The synthetic hair applying device 10 may be made of an elastic material, such as silicon rubber although other materials suitable for the device 10 may occur to those with ordinary skill in the art in light of the teachings herein.

Figure 5:
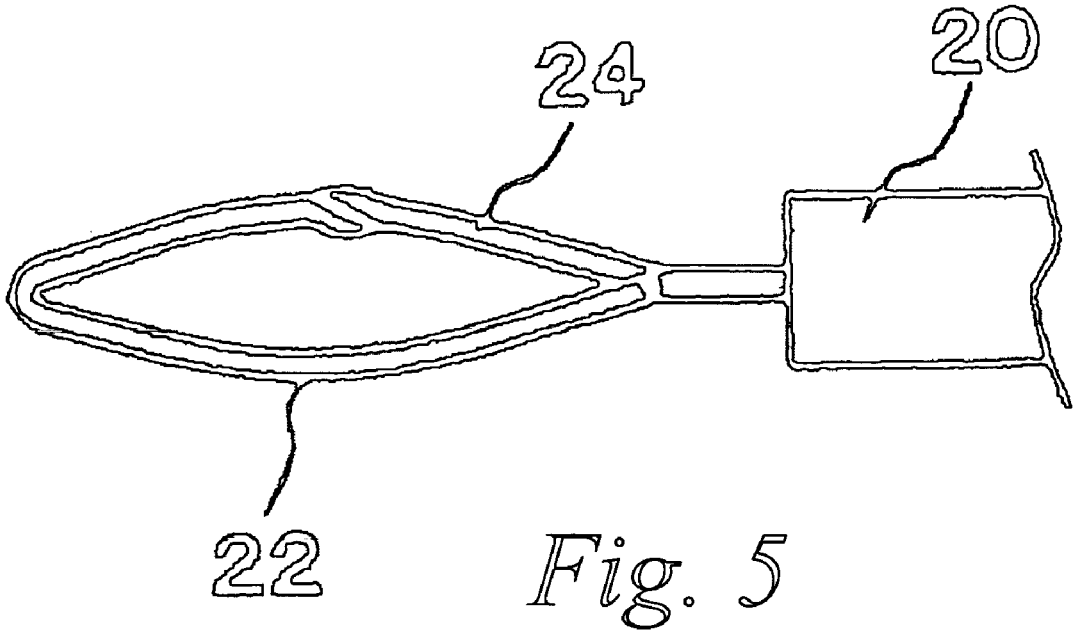
FIG. 5 is a side view of a needle used to apply hair extensions to a person's hair, shown with its loop closed.
Figure 6:
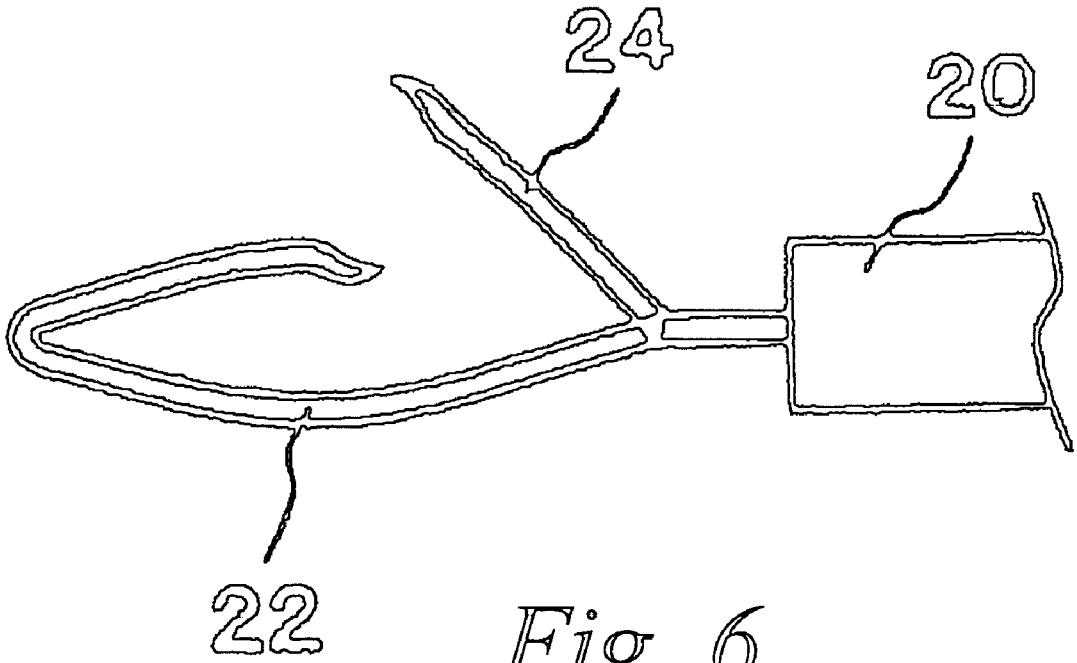
FIG. 6 is a side view of the needle of FIG. 5 with its loop opened.

The needle 20 shown in FIG. 5 is used to attach or apply hair extensions. In particular, the loop 22 of the needle 20 is compressed to flatten and inserted through the applying device 10 from the hair extensions side of the through-hole to the scalp side of the through-hole. Once the loop 22 penetrates the through-hole or hair retaining hole 12, the opener/closer 24 of the loop 22 is opened to take a bunch 26 of the person's hair into the loop 22.

Figure 4:
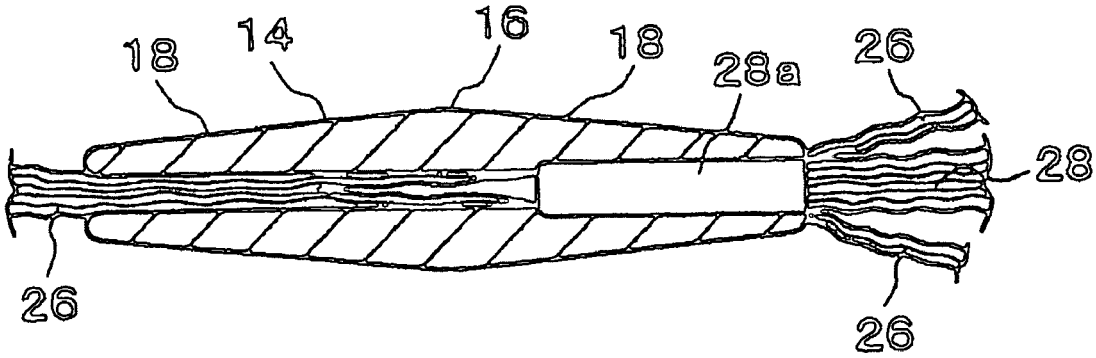
FIG. 4 is a cross section of the synthetic hair application device in FIG. 1, showing the device retaining a person's own hair in the retaining hole with the fixing end piece of the synthetic hair bunch of FIG. 2 fitted in the retaining hole.

The loop 22 is then closed and the needle 20 is pulled out to the hair extensions side with the loop 22 pinched to flatten. As shown in FIG. 4, this pulls the bunch 26 of the person's hair into the hair retaining hole 12 from the scalp side of the hole of the device 10.

Figure 2:
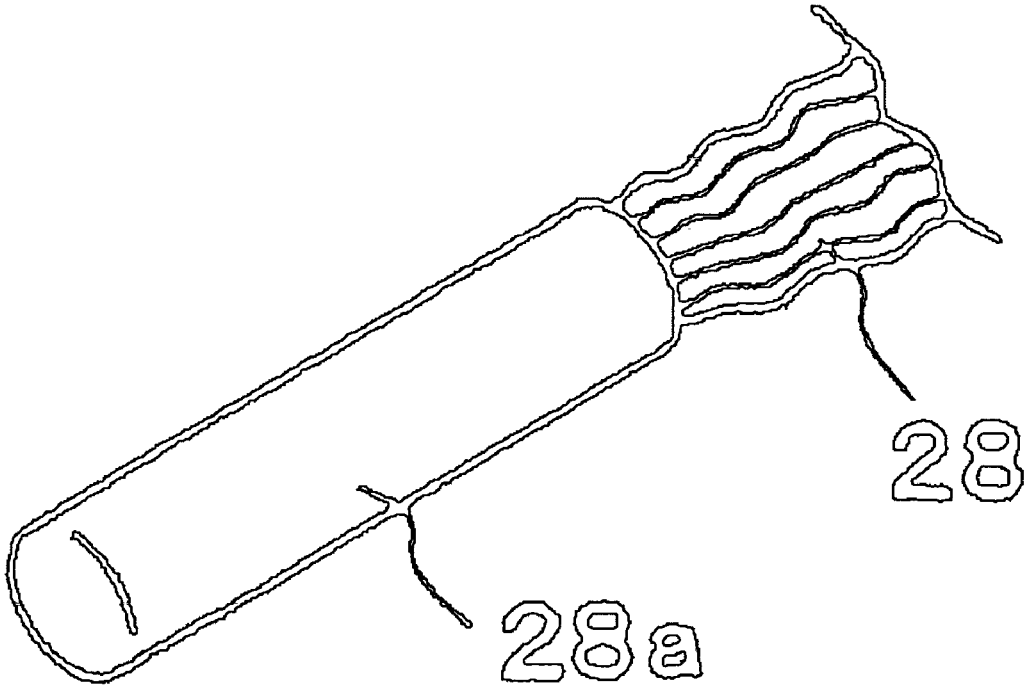
FIG. 2 is a perspective view of a bunch of synthetic hair with a fixing end piece formed at one end thereof.
Figure 3:
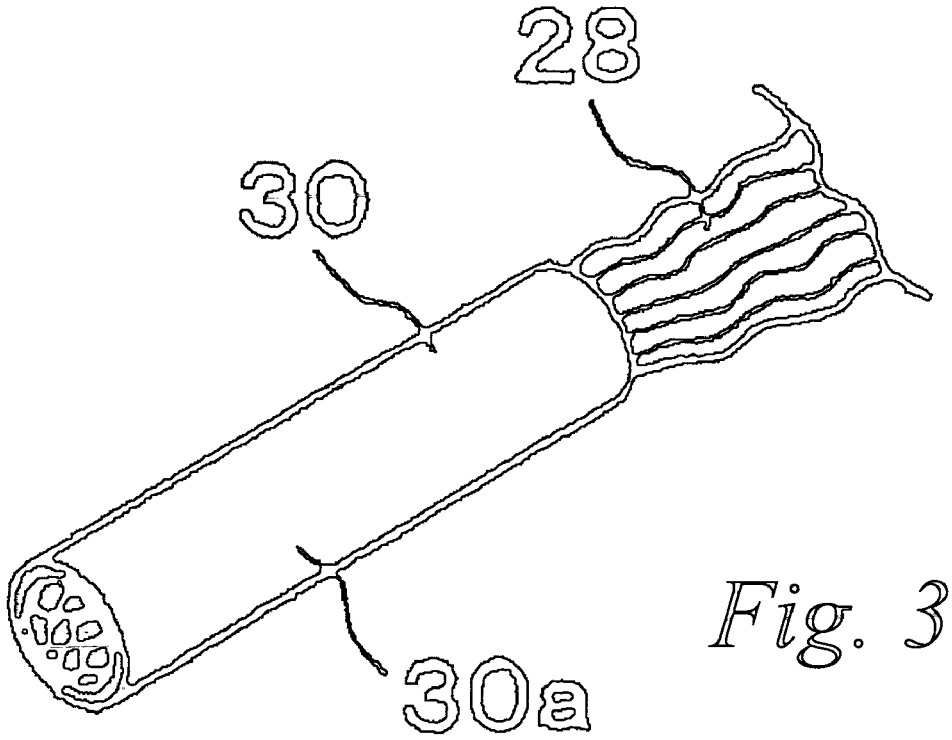
FIG. 3 is a perspective view of a bunch of synthetic hair with a resin tube fitted on one end thereof so as to form a fixing end piece.

Next, a suitable amount of synthetic hair 28 is taken and adhesive is applied to one end of the hair 28 to form a fixing end piece 28*a* (FIG. 2) so that the synthetic hair 28 can be fitted into the hair retaining hole 12 (now holding the bunch 26 of hair) at the end of the hole 12 from which the bunch 26 is pulled out (FIG. 4). Alternatively, as shown in FIG. 3, one end of the synthetic hair 28 may be inserted into a heat-shrinkable resin tube 30, which is then heated to provide a fixing end piece 30*a* with an appropriate length and hardness that holds together the hair 28.

As shown in FIG. 4, once the fixing end piece 28*a* is fitted into the hair retaining hole 12 of the synthetic hair applying device 10 from the extensions insertion end, the bunch 26 of hair, now in the hair retaining hole 12, is held between the inner wall that defines the hole 12 and the fixing end piece 28*a* so as to secure the bunch 26 of hair in the hair retaining hole 12. This also secures the bunch 28 of synthetic hair to the synthetic hair applying device 10 by means of the fixing end piece 28*a*. It should be noted that the fixing end piece 28*a* is removably connected to the synthetic hair applying device 10, such that when tugged on with sufficient force, the fixing end piece 28*a* may be pulled out of the hair retaining hole 12.

One of ordinary skill in the art will appreciate different ways to alter the parameters of the embodiments disclosed, such as the size, shape, or type of elements or materials, in a manner still in keeping with the spirit and scope of the present invention.

In should be noted that the present invention may be used with non-human hair, i.e., the methods and devices of the present invention may apply extensions to the hair of pets or other animals. Moreover, the methods and devices of the present invention may be used to add, extend, attach, or apply a bunch of any fibers (such as natural human and non-human hair, synthetic hair, other types of natural animal and plant fibers, synthetic fibers, filaments, threads, year, twine, and any other suitable materials) to a separate bunch of any of these fibers.

According to the present invention, synthetic hair and other similar materials for use as hair extensions can be previously processed or otherwise worked on to prepare a large number of fixing end pieces 28*a* and/or 30*a* prior to actual application of such material to persons' hair and keep the prepared pieces

28*a* and/or 30*a* in stock. This allows the application of hair extensions to be completed more quickly. Advantageously, the present invention provides a highly safe method and device for applying hair extensions as it dispenses with the use of any metal fastening hardware or parts or use of any heating devices, such as irons, in the extensions applying procedure.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

Having described the invention, what is claimed as new and desired to be secured by Letters Patent is:

1. A method of applying a bunch of hair extensions using a device, the device comprising:

a cylindrical body made of an elastic material having a hair retaining passage extending therethrough along a central axis of the cylindrical body, the cylindrical body having a central portion, a first axial end and an opposed second axial end provided at respective extremities of the cylindrical body, the hair retaining passage extending from the first axial end to the second axial end and having a constant diameter;

a first opening provided at the first axial end and a second opening provided at the opposed second axial end of the cylindrical body, wherein a person's hair enters into the hair retaining passage through the first opening and exits the hair retaining passage through the second opening; and wherein the central portion of the cylindrical body has a cross-sectional thickness greater than a cross-sectional thickness of the cylindrical body at the first and second axial ends, wherein the cylindrical body includes a pair of tapered surfaces provided on an outer surface of the cylindrical body, wherein the tapered surfaces continuously decrease in diameter from the central portion of the cylindrical body to the respective axial ends of the cylindrical body, wherein the method consists of:

passing a bunch of a person's hair through the hair retaining passage from the first axial end to the second axial end of the cylindrical body;

taking an appropriate amount of hair extensions to form a thickness that fits in the hair retaining passage and joining one end of the hair extensions with adhesive to form on that end a fixing end piece having a predetermined length and hardness; and inserting the fixing end piece into the hair retaining passage from the second axial end thereof so as to secure the bunch of person's hair to the fixing end piece in the hair retaining passage.

2. A method in accordance with claim 1, wherein the hair extensions are selected from the group consisting of a bunch of human hair, a bunch of synthetic hair, and ornamental objects.

3. A method in accordance with claim 1, wherein the elastic material comprises a silicon rubber.

4. A method in accordance with claim 1, wherein the step of inserting includes manually removably plugging the fixing end piece into the hair retaining passage from the second axial end thereof.

5. A method of applying a plurality of hair extensions using a device, the device comprising:

a cylindrical body made of an elastic material having a hair retaining passage extending therethrough along a central axis of the cylindrical body, the cylindrical body having a central portion, a first axial end and an opposed second axial end provided at respective extremities of the cylindrical body, the hair retaining passage extending from the first axial end to the second axial end and having a constant diameter;

a first opening provided at the first axial end and a second opening provided at the opposed second axial end of the cylindrical body, wherein a person's hair enters into the hair retaining passage through the first opening and exits the hair retaining passage through the second opening; and wherein the central portion of the cylindrical body has a cross-sectional thickness greater than a cross-sectional thickness of the cylindrical body at the first and second axial ends, wherein the cylindrical body includes a pair of tapered surfaces provided on an outer surface of the cylindrical body, wherein the tapered surfaces continuously decrease in diameter from the central portion of the cylindrical body to the respective axial ends of the cylindrical body, wherein the method consists of:

passing a bunch of a person's hair through the hair retaining passage from the first axial end to the second axial end of the cylindrical body;

taking an appropriate amount of hair extensions to form a thickness that fits in the hair retaining passage and joining one end of the hair extensions by placing and heating a heat-shrinkable resin tube around that end to secure the tube therearound and form a fixing end piece having a predetermined length and hardness; and inserting the fixing end piece into the hair retaining passage from the second axial end thereof so as to secure the bunch of person's hair to the fixing end piece in the hair retaining passage.

6. A method in accordance with claim 5, wherein the hair extensions are selected from the group consisting of a bunch of human hair, a bunch of synthetic hair, and ornamental objects.

7. A method in accordance with claim 5, wherein the elastic material comprises a silicon rubber.

8. A method in accordance with claim 5, wherein the step of inserting includes manually removably plugging the fixing end piece into the hair retaining passage from the second axial end thereof.

9. A system for attaching a first bunch of fibers to a second bunch of fibers, comprising:

a first bunch of fibers; a second bunch of fibers to be attached to the first bunch of fibers;

a cylindrical body made of an elastic material having a fiber retaining passage extending therethrough along a central axis of the cylindrical body, the cylindrical body having a central portion, a first axial end and an opposed second axial end provided at respective extremities of the cylindrical body, the fiber retaining passage extending from the first axial end to the second axial end and having a constant diameter;

a first opening provided at the first axial end and a second opening provided at the opposed second axial end of the cylindrical body, wherein the second bunch of fibers enters into the fiber retaining passage through the first opening and exits the fiber retaining passage through the second opening;

wherein the central portion of the cylindrical body has a cross-sectional thickness greater than a cross-sectional thickness of the cylindrical body at the first and second axial ends, wherein the cylindrical body includes a pair of tapered surfaces provided on an outer surface of the cylindrical body, wherein the tapered surfaces continuously decrease in diameter from the central portion of the cylindrical body to the respective axial ends of the cylindrical body; and a fixing end piece provided on an end of the first bunch of fibers, the fixing end piece having an outer diameter that is larger than the diameter of the fiber retaining passage, the fixing end piece being fitted into the fiber retaining passage through the second opening at the second axial end when the second bunch of fibers is placed through the fiber retaining passage such that the second bunch of fibers create an interference fit between the fixing end piece and the cylindrical body.

10. A system in accordance with claim 9, wherein the fixing end piece is formed by applying adhesive to the first bunch of fibers.

11. A system in accordance with claim 9, wherein the fixing end piece includes a heat-shrinkable tube heat-shrunken around the first bunch of fibers.

12. A system in accordance with claim 9, wherein the first and second bunch of fibers are selected from the group consisting of a bunch of human hair, a bunch of synthetic hair, and ornamental objects.

13. A system in accordance with claim 9, wherein the elastic material comprises a silicon rubber.

* * * * *